US006976869B1

(12) United States Patent
Wu

(10) Patent No.: US 6,976,869 B1
(45) Date of Patent: Dec. 20, 2005

(54) ELECTRICAL CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/863,929

(22) Filed: Jun. 8, 2004

(51) Int. Cl.[7] ..... H01R 12/24
(52) U.S. Cl. ..... 439/499
(58) Field of Search ..... 439/492–499, 439/701, 579, 924.1, 679, 79, 64, 604, 76.1, 439/77

(56) References Cited

U.S. PATENT DOCUMENTS 4,008,941 A * 2/1977 Smith ..... 439/358
6,585,536 B1 7/2003 Wu
6,585,537 B1 7/2003 Lee
6,648,676 B1 11/2003 Lee

* cited by examiner

*Primary Examiner*—Javaid H. Nasri
(74) *Attorney, Agent, or Firm*—Wei Te Chung

(57) ABSTRACT

An electrical cable assembly (100) comprises an insulative housing (1), a plurality of first and second contacts (21, 23), a plurality of wires (3), a spacer (4) attached to the insulative housing, a printed circuit board (6) assembled to the spacer and an insulative cover (5). The housing defines an elongated slot (123) therein along a longitudinal direction. The contacts are arranged in two rows on two sides of the slot. The first contacts comprise a power segment (218) and a signal segment (216). The printed circuit board comprises a plurality of traces (60, 62) each comprising a base portion (600) respectively soldered with wires in a one-to-one relationship and at least one beam (602) soldered with the tail portions (214) of the power segment in a one-to-one relationship. The number of the tail portions of the power segment is larger than that of corresponding wires. The tail portions (214, 236) of the signal segment of the first contacts and the second contacts are respectively soldered with the wires directly.

1 Claim, 9 Drawing Sheets

ELECTRICAL CABLE ASSEMBLY

CROSS-REFERENCE TO RELATED APPLICATIONS

This application is related to U.S. patent application Ser. No. 10/776,077 filed on Feb. 10, 2004, invented by William E. Spink, Jr, and entitled "HIGH SPEED ELECTRICAL CABLE ASSEMBLY", U.S. patent application Ser. No. 10/678,991 filed on Oct. 2, 2003 invented by George Zhang and entitled "HIGH SPEED ELECTRICAL CONNECTOR", U.S. patent application Ser. Nos. 10/456,369 filed on Jun. 6, 2003 and entitled "HIGH SPEED ELECTRICAL CONNECTOR", 10/787,661 filed on Feb. 25, 2004 and entitled "CABLE END CONNECTOR ASSEMBLY HAVING LOCKING MEMBER", U.S. patent application Ser. No. 10/834,456 filed on Apr. 28, 2004, entitled "ELECTRICAL CABLE ASSEMBLY", and all invented by Jerry Wu. The disclosure of these related applications is incorporated herein by reference.

BACKGROUND OF THE INVENTION

1. Field of the Invention

The present invention generally relates to an electrical cable assembly, and more particularly to a high speed Serial Attached SCSI (Small Computer System Interface) (SAS) cable assembly.

2. Description of Related Art

Computers are widely used in the fields of E-commerce, E-business, Home network, Internet work station and so on. Each computer has a data storage center, e.g. hard disk, where computer software and business data information are saved. When the computer runs, the computer CPU (Central Processing Unit) continuously accesses the hard disk and retrieves data from the hard disk or stores data to the hard disk. For compatibility, the hard disk drive interfaces are standardized. There are many hard disk drive interface standards and the SCSI (Small Computer System Interface) families and ATA (Advanced Technology Attachment) families are the most famous in the last decade.

Serial Attached SCSI (SAS) is a successor to the parallel SCSI and is based on serial technology. Besides the advantage of higher speed signal transmission, another most significant advantage is that the SAS interface will also be compatible with serial ATA (SATA) drives. The SAS receptacle connector has generally the same configuration as the SATA receptacle connector except that the two cavities of the SATA receptacle connector are merged in a large one, and a third set of signal contacts are assembled to a second side wall opposing a first side wall where two sets of contacts have already being assembled.

Generally, the SAS receptacle connector connects with other electronic equipment via a cable with wires terminated to the contacts thereof. An SAS cable end connector assembly comprises a housing, a plurality of contacts, a plurality of wires, and a cover over molded with the housing and the solder joints of the wires and the contacts. The contacts are disposed in opposite side walls of the housing with tail portions thereof projecting outside a rear end of the housing for soldering to corresponding wires. According to the SAS standard, the contacts comprise three sets of power contacts. Each set of power contacts consists of three power contacts and is adapted to be electrically connected with only one wire. However, it is difficult to correctly solder the specific three sets of miniature contacts and the freely movable wires together in an unsupported or unidentifiable condition. It is prone to solder the wire to an incorrect contact if the three sets of power contacts are not separated from other adjacent contacts. Therefore, it is necessary to provide a spacer to support and separate tail portions of the power contacts into several sets for easy identification during soldering. Further, during the over-molding process of the cover, the melted plastic material tends to seep into contact receiving passageways of the housing from rear end thereof, which will inevitably affect the quality of electrical connection between the cable end connector assembly and a mating connector. Furthermore, the one-to-multi connecting means causes the soldering operation between the power contacts and the wires relatively difficult to realize. It is highly desired to have an element to simplify the soldering operation and assure the electrical connection between the power contacts and corresponding wires.

BRIEF SUMMARY OF THE INVENTION

Accordingly, the object of the present invention is to provide a cable assembly having an additional printed circuit board (PCB), which can facilitate identification of particular contacts during soldering to corresponding wires.

In order to achieve the above-mentioned object, an electrical cable assembly in accordance with the present invention comprises an insulative housing, a plurality of first and second contacts disposed in the housing, a plurality of wires each comprising at least one conductor electrically connecting with a corresponding contact and a printed circuit board. The housing defines an elongated slot along a longitudinal direction thereof and comprises opposite longitudinal first and second walls located by two sides of the slot. The first and the second walls respectively define a plurality of first and second passageways through a rear face of the housing. The first and the second contacts are respectively disposed in corresponding first and second passageways with tail portions thereof exposed beyond the rear face of the housing. The printed circuit board comprises a plurality of traces, each trace comprises a base portion and at least one beam connecting with the base portion. The tail portions of the first contacts are respectively soldered with the beams of the printed circuit board in a one-to-one relationship and the wires electrically with the first contacts are respectively soldered with the base portions of the printed circuit board in a one-to-one relationship. The number of the tail portions is not equal to that of the wires. The tail portions of the second contacts are respectively soldered with corresponding wires to form electrical connection therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
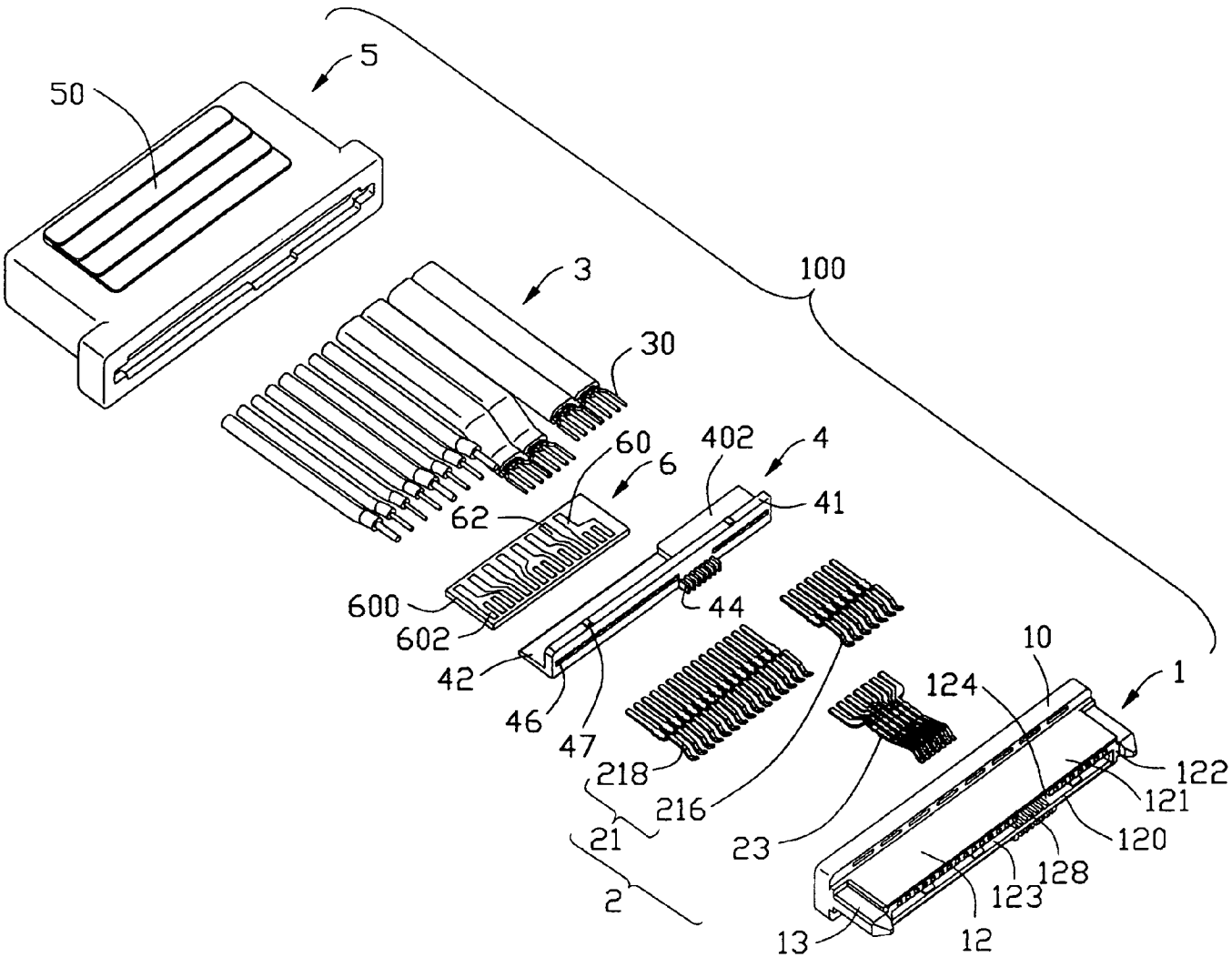
FIG. 1 is an exploded, perspective view of an electrical cable assembly in accordance with the present invention.

Reference will now be made to the drawing figures to describe the present invention in detail.

Figure 2:
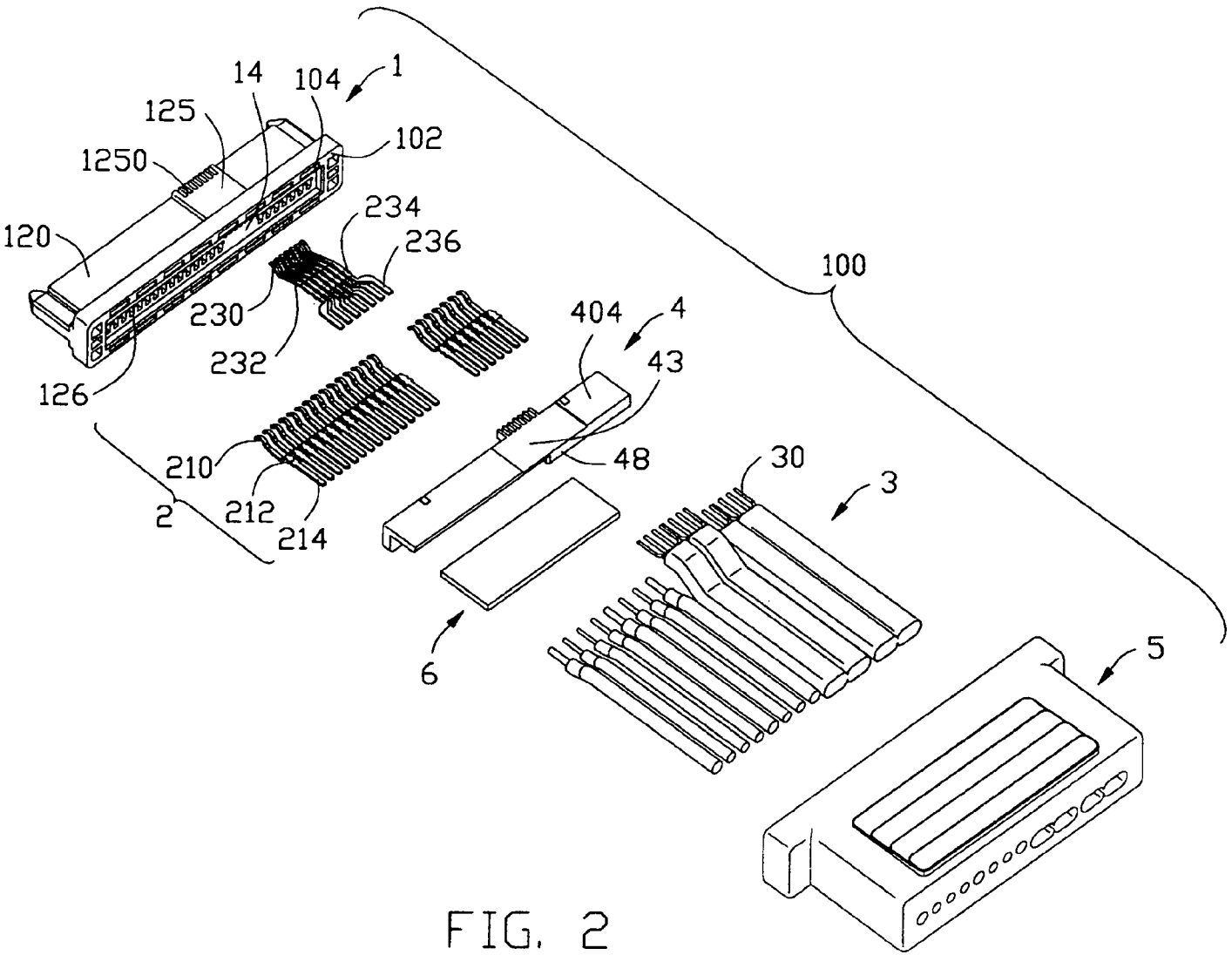
FIG. 2 is a view similar to FIG. 1, but viewed from a different angle.

Referring to FIGS. 1–2, an electrical cable assembly 100 in accordance with the present invention comprises an insulative housing 1, a plurality of contacts 2 received in the housing 1, a plurality of wires 3, a spacer 4 attached to the housing 1, a printed circuit board 6 assembled to the spacer 4 and electrically connecting with both the contacts 2 and the wires 3, and a cover 5 overmolded with the housing 1, tail portions of the contacts 2 and front portions of the wires 3.

The housing 1 is formed with an elongated base 10 and a mating portion 12 extending forwardly from the base 10. The base 10 defines a plurality of openings 104 arranged in two parallel rows at opposite sides thereof, and a rectangular recess 14 recessed from a rear face 102 thereof and located between the two rows of the openings 104. The mating portion 12 has opposite first and second elongated side walls 120, 121 and a pair of opposite lateral end walls 122 connecting with the first and the second side walls 120, 121, thereby together defining an uninterrupted central slot 123 along a lengthwise direction of the housing 1. A pair of forwardly extending guiding portions 13 respectively connect with exterior faces of the end walls 122. The first side wall 120 defines a channel 124 recessed from an interior face thereof and in communication with the central slot 123 in a transverse direction. The second side wall 121 comprises an expanded portion 125 in alignment with the channel 124 in the transverse direction. The channel 124 divides the first side wall 120 into two portions having different dimensions along the longitudinal direction. The thickness of the first side wall 120 is larger than that of the second side wall 121.

The housing 1 defines plural first passageways 126 in the first side wall 120 and plural second passageways 128 in the expanded portion 125 of the second side wall 121. The first and the second passageways 126, 128 extend through the mating portion 12 and the base 10 along a front-to-back direction in communication with the recess 14. The expanded portion 125 further defines plural opened cutouts 1250 extending from a front end thereof along the front-to-back direction and in communication with corresponding second passageways 128.

The contacts 2 comprise a plurality of first contacts 21 and a plurality of second contacts 23. Each first contact 21 comprises a curved contact portion 210, a rearwardly extending tail portion 214, and a retention portion 212 connecting the contact portion 210 and the tail portion 214. Each of the second contacts 23 comprises a contact portion 232, a retention portion 234, a tail portion 236 dependent from the retention portion 234, and an arcuate tip portion 230 extending forwardly from the contact portion 232 and curved in a direction opposite to that of the contact portion 232. The tail portions 236 of the second contacts 23 are laterally and outwardly offset to increase pitch thereof so as to facilitate soldering with corresponding wires 3.

The first contacts 21 comprise a signal segment 216 and a power segment 218. The contacts in the signal segment 216 and the second contacts 23, which are equal in number, are soldered with corresponding conductors 30 in a one-to-one relationship, and respectively comprise two pairs of differential signal contacts and three ground contacts arranged at opposite sides of each pair of the differential signal contacts. The power segment 218 includes three sets of power contacts, and two sets of ground contacts located between the adjacent two sets of power contacts. Each set of power contacts consists of three power contacts, which are together soldered to a power trace 60 of the printed circuit board 6. One set of ground contacts is soldered with corresponding grounding trace 62 of the printed circuit board 6 in the one-to-one relationship, and the other set of ground contacts consists of three ground contacts, two of which are soldered to a common grounding trace 62 and the remaining one is soldered to a corresponding grounding trace 62.

Figure 3:
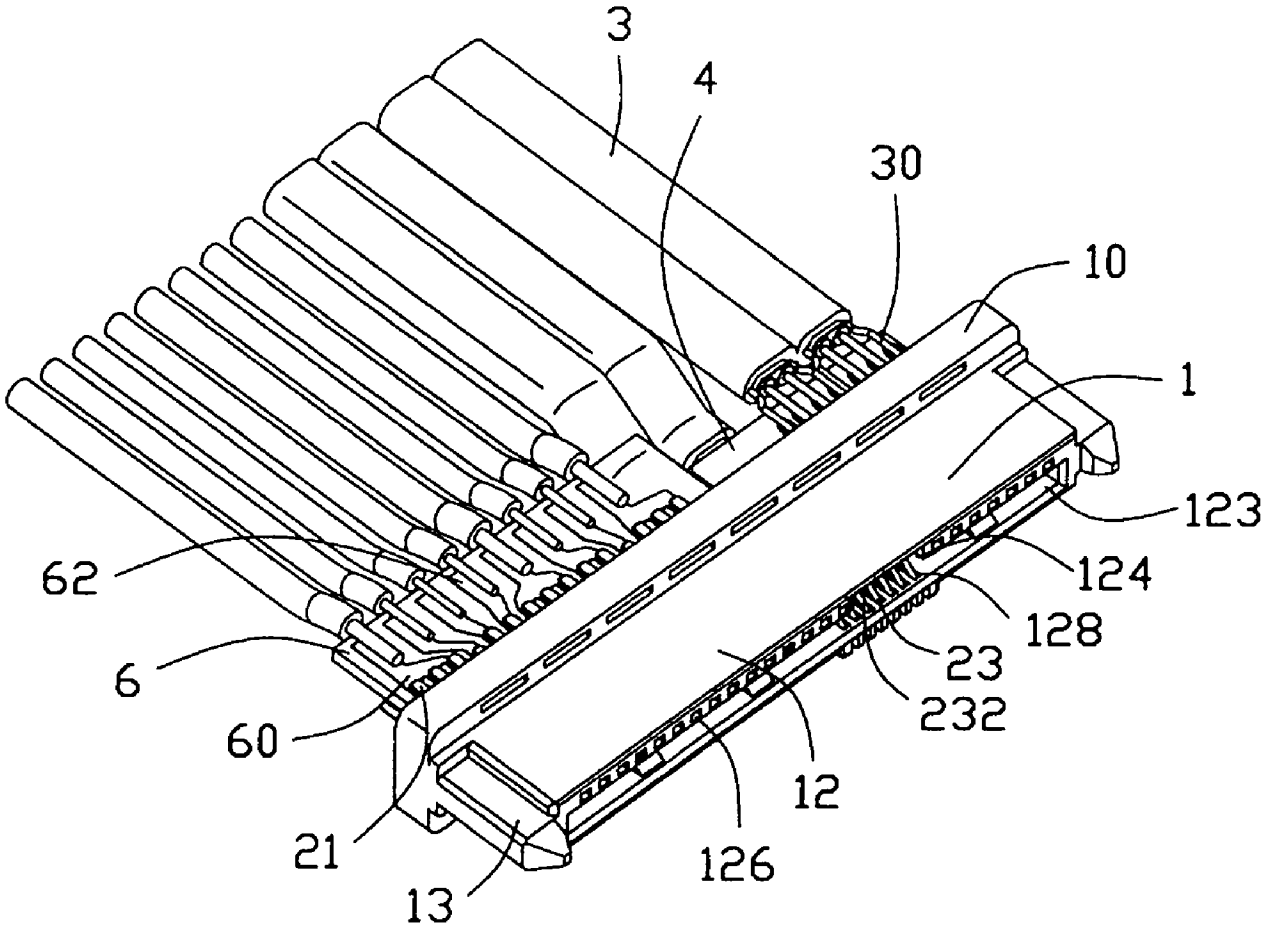
FIG. 3 is a partially assembled view of FIG. 1.
Figure 4:
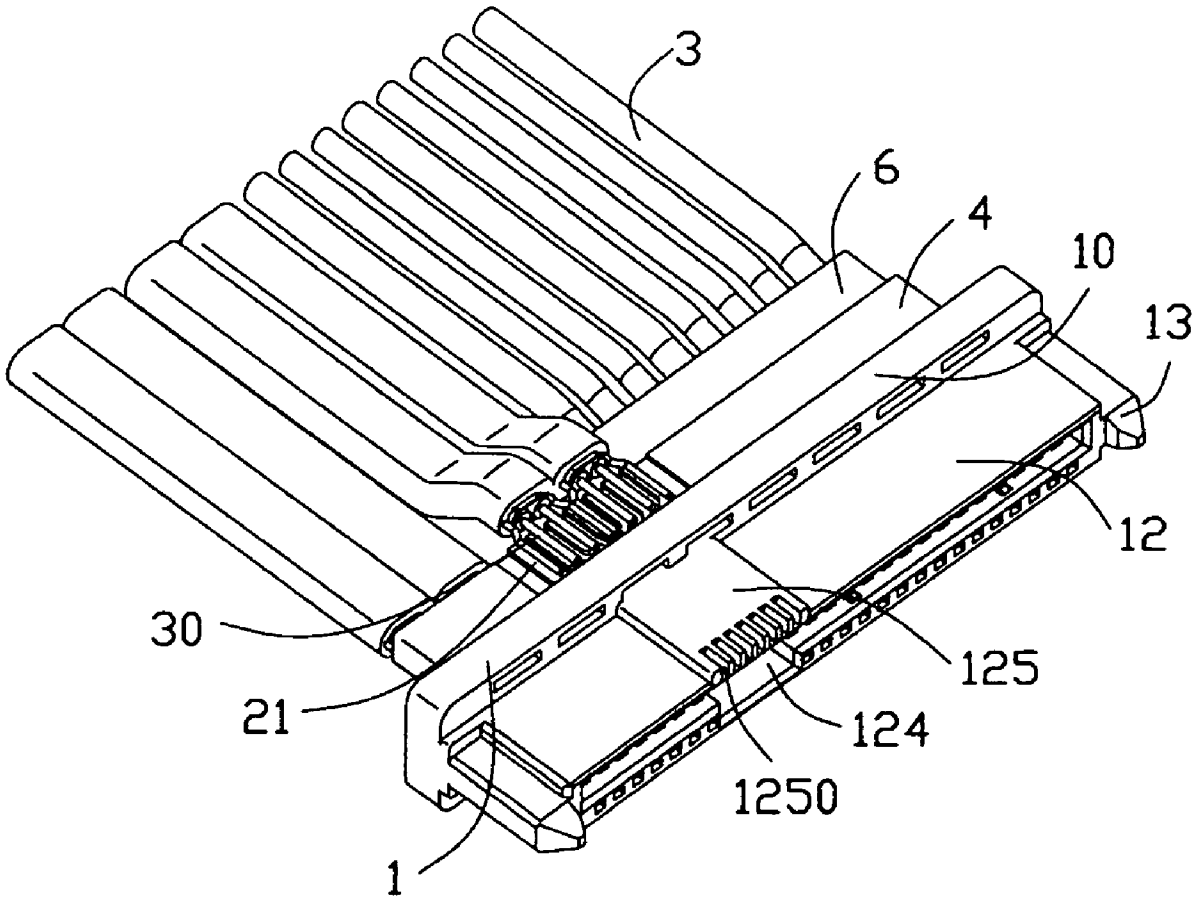
FIGS. 4–6 are views similar to FIG. 3, but viewed from different
Figure 5:
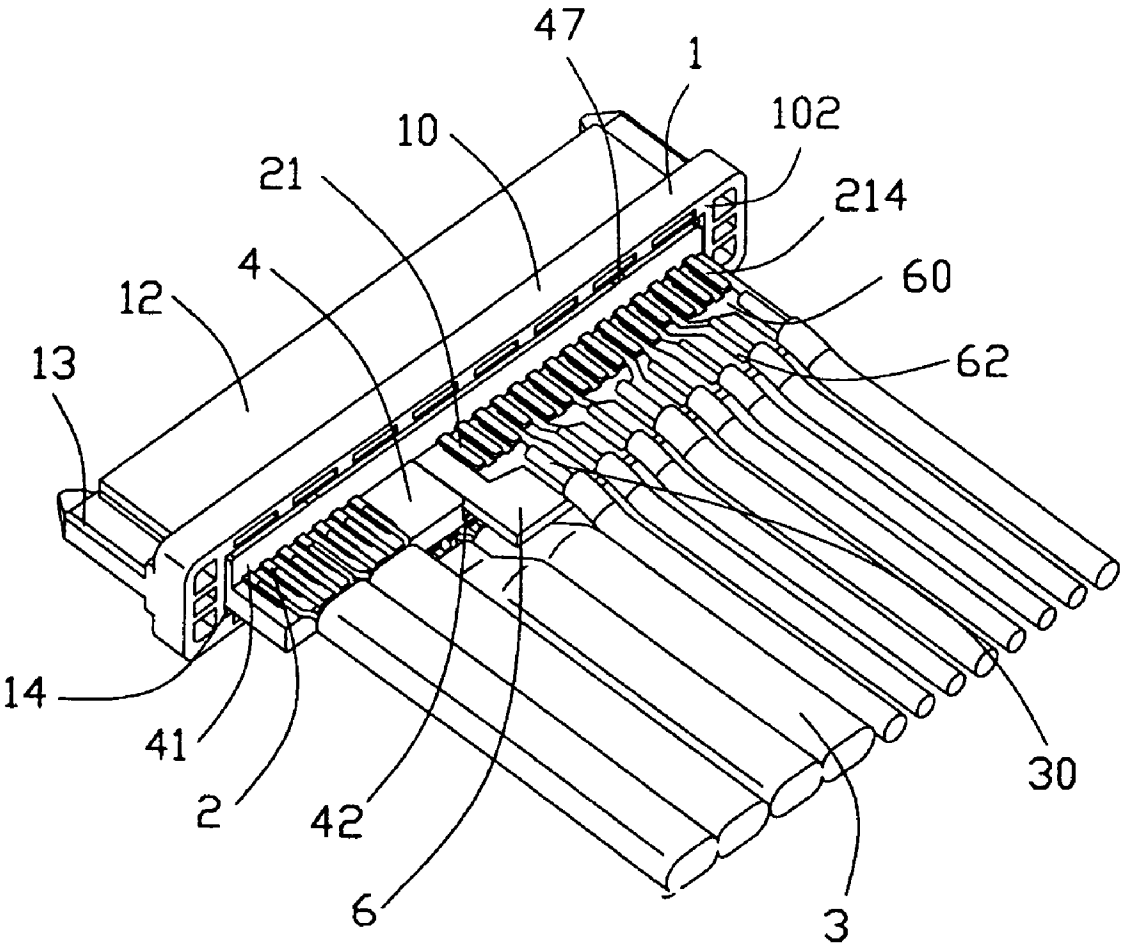
Figure 6:
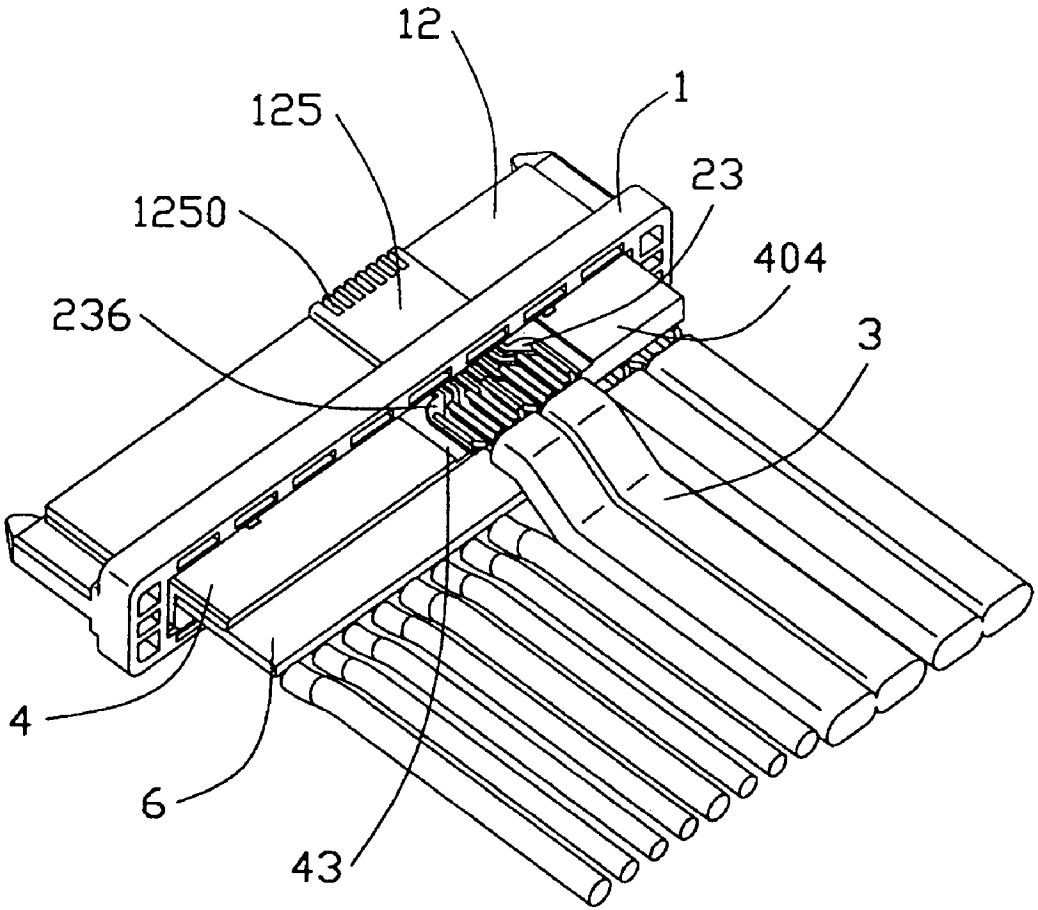
Figure 7:
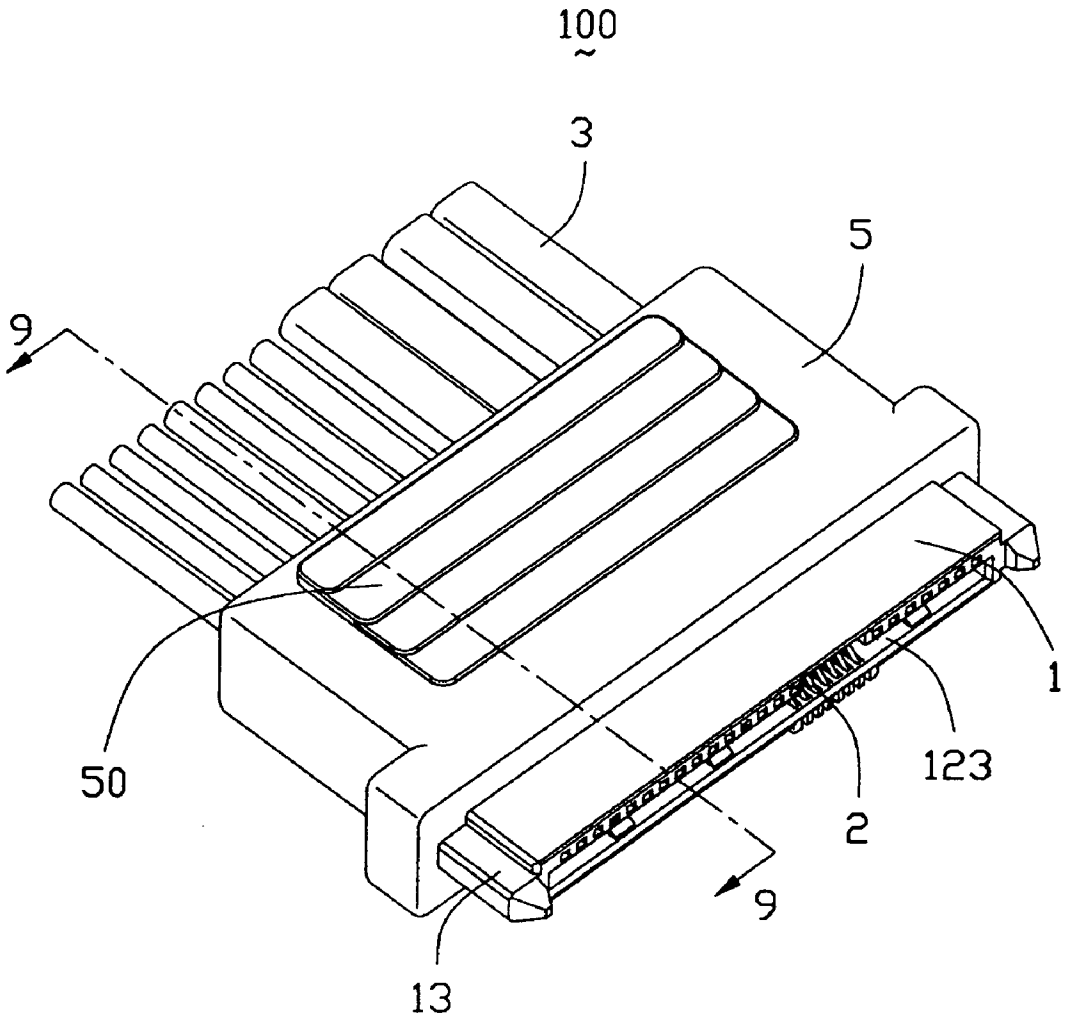
FIG. 7 is an assembled view of the electrical cable assembly of FIG.

Particularly referring to FIG. 3 and FIG. 4, the spacer 4 is elongated and comprises a first side 402 and a second side 404 opposite to the first side 402. A stop block 41 extending from the second side 404 and beyond the first side 402 along a direction perpendicular to the front-to-back direction. A rectangular opening 42 is defined in the first side 402 and recesses from a rear face of the stop block 41 to a rear end 48 of the spacer 4. The second side 404 is formed with a platform 43 having a surface lower than that of second side 404. The stop block 41 is further formed with a plurality of through holes 46 at the locations corresponding to those of the first passageways 126 in the housing 1, and a pair of protrusions 47 on each of two sides thereof. The spacer 4 further comprises a plurality of positioning ribs 44 extending forwardly from a front face thereof at the locations corresponding to those of the third grooves 128 of the housing 1.

The wires 3 comprise a plurality of individual conductors 30 for respectively soldering to corresponding tail portions 214, 236 of the contacts 2.

The printed circuit board 6 is formed with three sets of power traces 60 and two sets of grounding traces 62 located between the adjacent two sets of power traces 60. Each trace 60, 62 comprises a base portion 600 for electrically connecting with a corresponding wire 3 and at least one beam 602 connecting with the base portion 600 for electrically connecting with a corresponding contact 2. To be depicted in detail, each set of power trace 60 has a fork shape, that is, the power trace 60 comprises three beams 602 connecting to a common base portion 600. One set of grounding traces 62 comprises a two-beam one and a one-beam one, while the other set of grounding traces 62 comprises three one-beam ones.

Figure 9:
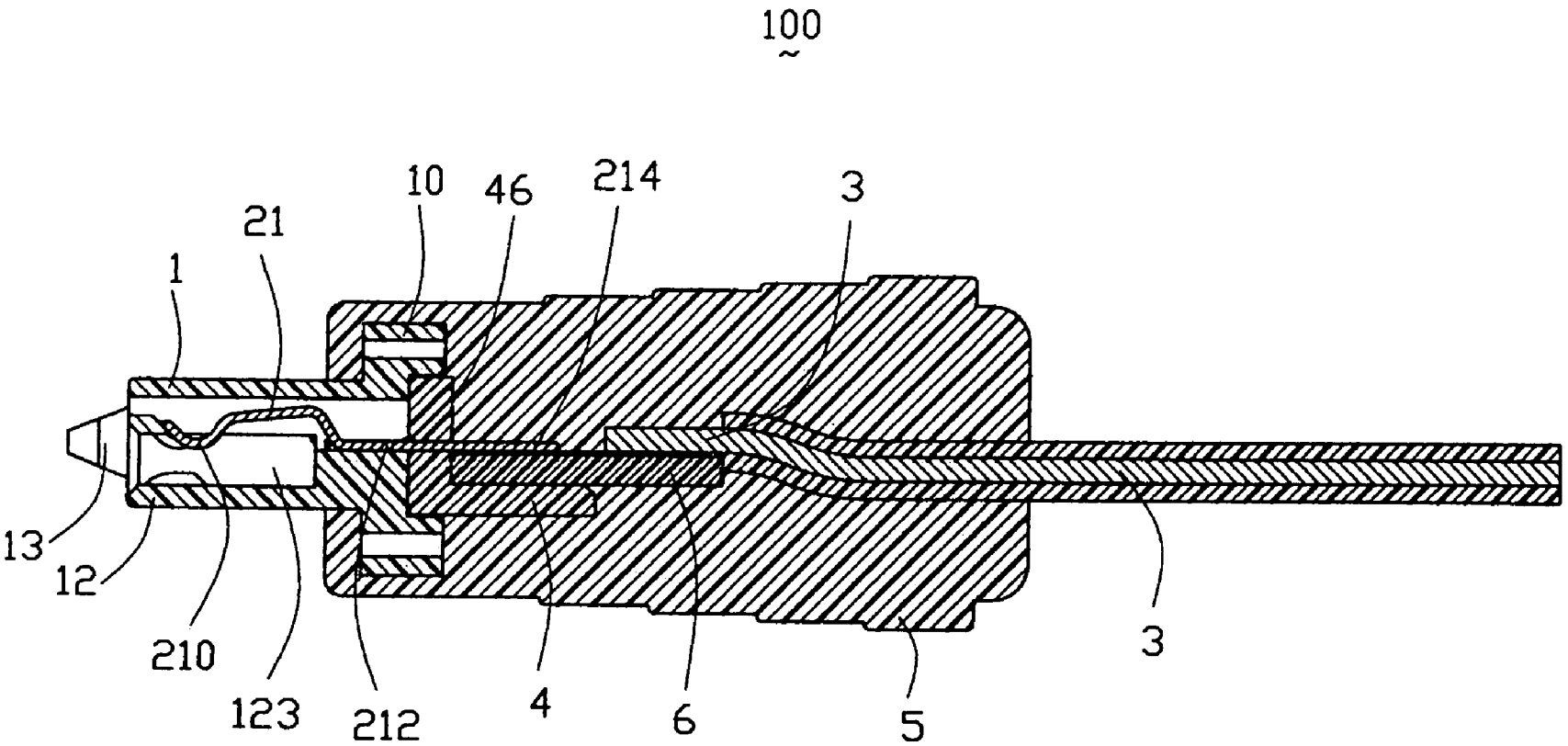
FIG. 9 is a cross-sectional view taken along line 9—9 of FIG. 8.

Referring to FIGS. 1–6 in conjunction with FIG. 9, the first and the second contacts 21, 23 are respectively inserted into the first and the second passageways 126, 128 of the housing 1, with the contact portions 210, 232 thereof exposed in the central slot 123, with the retention portions 212, 234 thereof interferentially engaging with corresponding passageways 126, 128, and with the tail portions 214, 236 thereof outside the rear face 102 of the housing 1. Moreover, the tip portions 230 of the second contacts 23 are respectively exposed in the cutouts 1250 of the expanded portion 125, thereby providing enough space for elastic deformation of the tip portions 230 when the cable assembly 100 is mated with a complementary connector. The spacer 4 is assembled to the rear end of the housing 1 with the printed circuit board 6 received in the opening 42 thereof. The positioning ribs 44 are respectively inserted into the second passageways 128 for interconnecting the spacer 4 in the housing 1 and sealing the second passageways 128. The stop block 41 is fittingly received in the recess 14 with the protrusions 47 thereof interferentially engaging with interior side surfaces of the recess 14. The tail portions 214 of the first contacts 21 respectively pass through the through holes 46 of the spacer 4.

To be depicted in detail, three tail portions 214 of each set of power contacts of the power segment 218 are respectively soldered to three beams 602 of each power trace 60 of the printed circuit board 6, while a conductor 30 of the wire 3 is soldered to the common base portion 600 of the power trace 60. Two tail portions 214 of one set of ground contacts of the power segment 218 are respectively soldered to the two beams 602 of one set of grounding traces 62, while a corresponding conductor 30 of the wire 3 is soldered to the common base portion 60. Tail portions 214 of the remaining ground contacts of the power segment 218 are respectively soldered to the beams 602 of the remaining grounding traces 62. The contacts of the signal segment 216 are respectively located on the first side 402 of the spacer 4 and respectively soldered with corresponding conductors 30. The tail portions 236 of the second contacts 23 are directly placed on the platform 43 and respectively soldered with corresponding conductors 30 of the wires 3.

The three sets of power contacts and one set of ground contacts of the first contacts 21 are separated from adjacent contacts 21, so the possibility of mis-soldering is eliminated. Furthermore, the numbers of the base portions 600 and the beams 602 of the additional printed circuit board 6 are respectively equal to that of the tail portions 214 of the power segment 218 and that of the conductors 30 of corresponding wires 3, this undoubtedly simplifies the soldering connection between the power contacts 218 and corresponding wires 3. In addition, since the conductors 30 of the wires 3 and the tail portions 214, 235 of the contacts 2 are simultaneously supported by the spacer 4 and the printed circuit board 6, reliability of the solder connection is greatly improved and alignment for the soldering process is facilitated.

Figure 8:
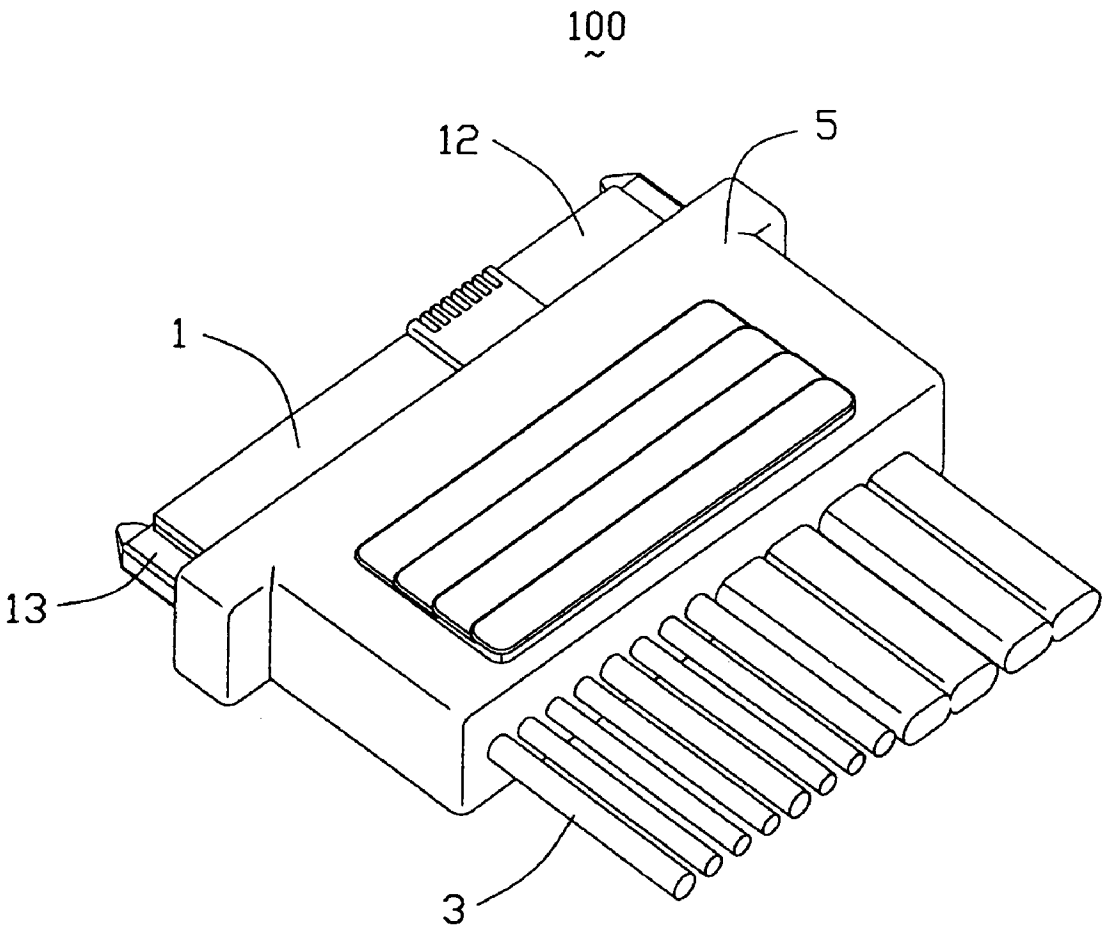
FIG. 8 is a view similar to FIG. 1, but viewed from a different angle.

Referring to FIGS. 8–10, an additional insulative cover 5 is provided after the housing 1, the contacts 2, the spacer 4, the printed circuit board 6, and the wire 3 are assembled together. The cover 5 is molded over the base 10 of the housing 1 and molded over the solder connection between the contacts 2 and the wire 3. A plurality of ribs 50 is formed on upper and lower surfaces of the insulative cover 5 for being grasped conveniently. During overmolding process, since the positioning ribs 44 and the stop block 41 of the spacer 4 seal the passageways 126, 128 from the rear end of the housing 1, the plastic material used in forming the cover 5 will not overflow and seep into the housing 1. Moreover, due to the constraining and supporting functions of the grooves 45, 432 of the spacer 4, even if the tail portions 214, 236 of the contacts 2 are subjected to the high pressure of the plastic material injected during the molding of the cover 5, the tail portions 214, 236 of the contacts 2 will not displaced. Aside from that, the plastic material will overflow the openings 104 of the housing 1 during molding the cover 5 to prevent the cover 5 from separating from the housing 1 after cooling down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable assembly, comprising:

an insulative housing defining an elongated slot along a longitudinal direction thereof, the housing comprising opposite longitudinal first and second walls located by two sides of the slot, the first wall and the second wall respectively defining a plurality of first passageways and second passageways therein through a rear face of the housing;

a plurality of first contacts and second contacts respectively disposed in corresponding first passageways and second passageways, each of the first and second contacts having a tail portion exposed beyond the rear face of the housing;

a plurality of wires each comprising at least one conductor electrically connecting with a corresponding contact; and a printed circuit board comprising a plurality of traces, each trace comprising a base portion and at least one beam connecting with the base portion; and wherein the tail portions of the first contacts are soldered to the beams of the printed circuit board in a one-to-one relationship and the wires electrically connecting with the first contacts are respectively soldered with the base portions of the printed circuit board in a one-to-one relationship, the number of the tail portions is not equal to that of the wires, the tail portions of the second contacts are respectively soldered with corresponding wires to form electrical connection therebetween; wherein the first contacts comprise a power segment and a signal segment, and wherein the power segment is soldered with the printed circuit board to electrically connect with corresponding wires and the signal segment is soldered with corresponding wires directly, further comprising a spacer, and wherein the housing defines a recess in the rear face in communication with the first and the second passageways to receive the spacer;

wherein the spacer defines a first side and an opposite second side along the longitudinal direction, the first side is provided with an opening, and wherein the printed circuit board is located in the opening;

wherein the spacer comprises a stop block extending from the second side and beyond the first side to be fittingly received in the recess;

wherein the stop block defines a plurality of through holes corresponding to the first passageways of the insulative housing, and wherein the tail portions of the power segment and the signal segment of the first contacts respectively protrude through the through holes and are located on the printed circuit board and the first side of the spacer;

wherein the spacer is provided with a platform having a surface lower than that of the second side thereof, and wherein the tail portions of the second contacts are located on the platform;

wherein the spacer comprises a plurality of positioning ribs extending forwardly from a front end thereof and respectively received in the second passageways for retaining the spacer to the housing;

wherein the second passageways of the housing are offset from the first passageways in a transverse direction;

wherein each of the second contacts comprises a contact portion opposite to the tail portion, a retention portion connecting the contact portion and the tail portion, and a curved tip portion extending forwardly from the contact portion, and wherein the second wall of the housing has an expanded portion defining a plurality of opened cutouts in communication with corresponding second passageways and providing enough space for deformation of the tip portions of the second contacts, when the cable assembly is mated with a complementary connector;

wherein the housing defines a channel in an interior face of the first wall in alignment with the expanded portion in a transverse direction perpendicular to the longitudinal direction;

wherein the pitch of the tail portions of the first contacts is different from that of the tail portions of the second contacts;

wherein the tail portions of the second contacts are laterally and outwardly offset to increase pitch thereof so as to facilitate soldering with corresponding wires;

further comprising an insulative cover overmolded on the housing, the tail portions of the contacts and front portions of the wires.

* * * * *